US010464765B2

(12) United States Patent
Chatry et al.

(10) Patent No.: US 10,464,765 B2
(45) Date of Patent: Nov. 5, 2019

(54) ARRANGEMENT AND METHOD FOR HANDLING PAPER ELEMENTS

(71) Applicant: BOBST MEX SA, Mex (CH)

(72) Inventors: Patrice Chatry, Lugrin (FR); Olivier Fauconneau, Lausanne (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 15/763,268

(22) PCT Filed: Oct. 13, 2016

(86) PCT No.: PCT/EP2016/025115
§ 371 (c)(1),
(2) Date: Mar. 26, 2018

(87) PCT Pub. No.: WO2017/063758
PCT Pub. Date: Apr. 20, 2017

(65) Prior Publication Data

US 2018/0222707 A1 Aug. 9, 2018

(30) Foreign Application Priority Data

Oct. 13, 2015 (EP) ..... 15020185

(51) Int. Cl.
*B65H 5/22* (2006.01)
*B65H 29/10* (2006.01)
*B65H 29/24* (2006.01)

(52) U.S. Cl.
CPC ..... *B65H 5/222* (2013.01); *B65H 29/10* (2013.01); *B65H 29/241* (2013.01);
(Continued)

(58) Field of Classification Search
CPC .... B65H 5/222; B65H 29/241; B65H 29/686; B65H 2406/31; B65H 2406/312;
(Continued)

(56) References Cited

U.S. PATENT DOCUMENTS 3,972,523 A 8/1976 Brandes ..... 271/183
2015/0102554 A1 4/2015 Ansermot

FOREIGN PATENT DOCUMENTS

DE 196 14 491 A1 11/1996
EP 1 935 820 A2 6/2008

OTHER PUBLICATIONS

International Search Report dated Jan. 4, 2017 in corresponding PCT International Application No. PCT/EP2016/025115.
(Continued)

*Primary Examiner* — David H Bollinger
(74) *Attorney, Agent, or Firm* — Ostrolenk Faber LLP

(57) ABSTRACT

An arrangement (100) for handling flat elements (202), in particular paper elements (202). A guiding structure (101) is provided, along which a flat element (202) is guidable and transportable along a transport direction (T). A hold-down element (102) is coupled to the guiding structure (101) for holding down the flat element (202) to the guiding structure (101). The hold-down element (102) has a support section (103) on which the flat element (202) is supportable. The hold-down element (102) extends along an extending direction (116) having a component perpendicular to the transport direction (T), wherein suction holes (104) are arranged along the extending direction (116). A suction unit (110) includes a suction opening (111) coupled to the suction holes (104) of the hold-down element (102), an air inlet (112) and an air outlet (113), wherein the suction unit (110) directs air from the air inlet (112) to the air outlet (113) for generating an air flow (114). The suction opening (111) is formed and arranged such that the air flow (114) passes the suction opening (111) so that air flow (114) entrains air through the suction opening (111).

15 Claims, 6 Drawing Sheets

(52) U.S. Cl.
CPC .. *B65H 2406/31* (2013.01); *B65H 2406/3432* (2013.01); *B65H 2406/351* (2013.01); *B65H 2406/3663* (2013.01)

(58) Field of Classification Search
CPC ..... B65H 2406/3432; B65H 2406/366; B65H 2406/3661; B65H 2406/351
See application file for complete search history.

(56) References Cited

OTHER PUBLICATIONS

Written Opinion dated Jan. 4, 2017 in corresponding PCT International Application No. PCT/EP2016/025115.

ARRANGEMENT AND METHOD FOR HANDLING PAPER ELEMENTS

CROSS-REFERENCE TO RELATED APPLICATIONS

The present application is a 35 U.S.C. §§ 371 national phase conversion of PCT/EP2016/025115, filed Oct. 13, 2016, which claims priority of European Patent Application No. 15020185.3, filed Oct. 13, 2015, the contents of which are incorporated by reference herein. The PCT International Application was published in the English language.

FIELD OF INVENTION

The present invention relates to an arrangement and a method for handling paper elements. More generally, the present invention relates to a system for processing flat elements.

ART BACKGROUND

In the field of paper processing it is necessary to place and hold paper sheets in a desired location and orientation before feeding the paper sheets into a paper processing device, such as a cutting machine or a paper printing machine. The paper sheets are flat and flexible elements which have to be handled in a controlled manner.

SUMMARY OF THE INVENTION

There may be a need to provide a flexible and robust arrangement for handling flat elements, in particular in a paper processing system.

According to a first aspect of the present invention, an arrangement for handling flat elements, in particular paper elements or sheets, is presented. The arrangement comprises a guiding structure (which forms e.g. at least a part of a sheet conveyance path), along which a flat element is guidable and transportable along a transport direction, and a hold-down element which is coupled to the guiding structure for holding the flat element down to the guiding structure. The hold-down element comprises a support section on which the flat element is supportable. The support section comprises suction holes through which air is drawn for holding the flat element down on the support section. The hold-down element extends along an extending direction having a component perpendicular to the transport direction, wherein the suction holes are arranged along the extending direction. In other words, the extending direction is nonparallel with respect to the transport direction. Specifically, the extending direction is oriented perpendicular with respect to the transport direction.

The arrangement further comprises a suction unit which may be arranged spaced apart from the hold-down element for allowing flexible positioning of the suction unit. Alternatively, the suction unit may be located next to the hold-down element. This could be adjacent one end of the hold-down element, for example. In this manner the suction and the hold-down element may even form a unitary sub-assembly. The suction unit comprises a suction opening arranged to be coupled by a fluid line, pipe or tube or the like to the suction holes of the hold-down element, an air inlet and an air outlet. The suction unit is formed such that air is directed, using a fan or a pump or similar, from the air inlet to the air outlet generating an air stream or flow. The stream or flow may be from a compressed air source, a pump, or fan, or the like. The suction opening is formed and arranged such that the air flow passes adjacent to the suction opening. In this manner air is drawn from the suction holes via the suction opening to be entrained in the air stream running from the air inlet to the air outlet.

According to a further aspect of the present invention, a method for handling flat elements, in particular paper elements, is presented. According to the method a flat element is guided and transported along a transport direction by a guiding structure. Furthermore, the flat element is held down to the guiding structure by a hold-down element, which is coupled to the guiding structure. The hold-down element comprises a support section on which the flat element is supportable. The support section comprises suction holes through which air is drawn for holding the flat element down on the support section. The hold-down element extends along an extending direction having a component perpendicular to the transport direction, wherein the suction holes are arranged one after another along the extending direction. A suction unit may be arranged spaced apart from or adjacent to the hold-down element. The suction unit comprises a suction opening so as to be coupled to the suction holes of the hold-down element, an air inlet and an air outlet. The suction unit is formed such that compressed air is directed from the air inlet to the air outlet for generating a compressed air stream, wherein the suction opening is formed and arranged such that the compressed air stream passes the suction opening so that compressed air stream entrains air through the suction opening.

According to a further aspect of the present invention, a system for processing flat elements, in particular paper elements, is presented. The system comprises a (paper) processing device for processing flat elements and an arrangement as described above. The guiding structure of the arrangement is coupled to the (paper) processing device in such a way that the flat elements are guidable and transportable along a transport direction to or from the (paper) processing device.

According to a further aspect of the present invention, a high pressure system is installed, e.g. inside a building. The high pressure system comprises lines through which a pressurized medium, such as pressurized air, is directed. The lines comprise connection locations to which the compressed air connection element of the arrangement may be detachably coupled.

The flat elements have a width and length which are much larger than the thickness of the respective flat elements. Specifically, the length and the width of the flat elements are at least 10 times larger than the thickness of the flat elements. For example, the flat elements have a sheet-like shape and may be stackable on top of each other to form a stack of flat elements. In particular, the flat elements are paper elements. The paper elements are for example paper sheets made of a paper or a carton/cardboard structure.

The guiding structure comprises for example a support area on which the flat elements are supportable and movable along the transport direction. Furthermore, the guiding structure may be fixed to the ground, to a supporting frame (as described below) and/or to a subsequent processing device, in particular a paper processing device, such that the flat elements are guidable along the guiding structure to or away from the processing device. Furthermore, the guiding structure may be formed of a framework made of bars or the like, for example.

The transport direction describes the direction of movement of the flat elements during the processing of the flat elements. Specifically, the transport direction describes the direction of movement of the flat elements along the sheet conveyance path when passing the hold-down element. The transport direction is defined and adjusted by guiding means, such as guiding rails or the like. The guiding structure may for example comprise one or more conveyor belts or transport rollers etc. along and by which the flat elements are moved and guided.

The hold-down element may be a tube or a hollow beam having a rectangular, square or other polygonal cross-section, or any other suitable cross section such as a circular or elliptical cross-section. The hold-down element is coupled to the guiding structure such that the flat elements may be transported between the support section of the hold-down element and the support area of the guiding structure. The hold-down element and the guiding structure are arranged adjacent with respect to each other along the transport direction. In particular, the hold-down element is arranged upstream or downstream of the support area of the guiding structure with respect to the transport direction. A small gap may exist between the hold-down element and the guiding structure or the hold-down element and the guiding structure contact each other. The hold-down element comprises the support section, on which the flat element is supportable by moving along the transport direction. When passing the support section of the hold-down element, the flat element is held down to the support section and is for example fixed to the support section such that a further movement of the flat elements along the transport direction is disabled or decelerated.

The hold-down element comprises suction holes through which air is drawn for holding the flat element down on the support section. In particular, a partial vacuum is generated within the hold-down element, such that the air is drawn from the outside of the hold-down element through the respective suction holes into the hold-down element.

By the term "holding down the flat element to the support section" it may be understood to fixedly hold the flat element or to slow the flat element when it is passing the support section along the transport direction. The suction of the air may be controlled in such a way that a positive control of the position of the flat element is provided, particularly when the sheet is being decelerated (for example) prior to entering a processing station. This prevents the rear of the flat element from rising up in a vertical direction, fluttering, and possibly starting to overtake a portion of the flat element that is more advanced in the direction of travel.

In order to generate the underpressure within the hold-down element, air is drawn through the suction holes and then, via a connecting tube or other conduit, to the suction unit. A pressurized air source, such as an air pump the like as described further in detail below, is coupled to the air inlet of the suction unit. Thereby, an air flow or a compressed air stream is formed between the air inlet and the air outlet of the suction unit. The compressed air stream between the air inlet and the air outlet passes the suction opening. In this manner, the compressed air stream entrains the air from the suction holes through the suction opening. This provides an under-pressure within the hold-down element. In other words, the compressed air stream guides air under pressure through the suction unit between the air inlet and the air outlet, wherein the compressed air stream communicates laterally with the suction opening. The suction opening may form a throttle and hence may have a smaller opening diameter (i.e. at the downstream end of the suction opening inside the suction device) close to the compressed air stream than the larger opening diameter (i.e. at the upstream end of the suction opening) close to the suction hole of the hold-down element. Hence, the resulting Venturi effect creates a vacuum inside the suction opening such that air is sucked from the suction through hole of the hold-down element into the suction unit.

It is therefore possible to connect a pressurized air source to the suction unit in order to suck air through the suction opening and further to blow the air through the air outlet out of the suction unit. It is not necessary to plug to the air outlet a vacuum pump. This has the advantage that particles (for example dirt of paper or cardboard fiber) within the air drawn through the suction hole are not sucked into such a vacuum pump. Such particles are simply blown out through the air outlet of the suction unit into the environment. Hence, this avoids damage to the pump and thus a more robust suction arrangement may be provided.

According to the present invention, the hold-down element is arranged such that the extending direction of the hold-down element and the arrangement of the suction holes are in an embodiment perpendicular to the transport direction. The extending direction defines e.g. the length of the hold-down element. Hence, the hold-down element may be simply interposed between two adjacent guiding areas of the guiding structure, for example. Hence, a simple installation of the hold-down element is possible.

Additionally, the hold-down element may be manufactured in a simple and robust manner, because no further installation means have to be installed inside the hold-down element. The suction unit according to one embodiment of the invention is arranged spaced apart from the hold-down element and coupled, e.g. by a line or a hose, to the respective suction holes. Hence, the hold-down element may be manufactured for example as a hollow bar or tube comprising the suction holes so that the hold-down element is easy to install to the respective guiding structure. No further complex installations inside the hold-down element for controlling the air flow through the suction holes are necessary. Furthermore, because the hold-down element does not comprise any further technical installations, that hold-down element requires a very small installation space. Hence, the hold-down element may be formed in an integral and in a monolithic manner.

For this reason, the arrangement according to the present invention may be inexpensive to manufacture and may require a very small installation space. The present invention is in particular useful in situations where cost is an issue and efficient power hold down forces are required, e.g. when using paper sheets as flat elements.

According to a further exemplary embodiment, the arrangement further comprises a compressed air connection element coupled to the air inlet of the suction unit, wherein the compressed air connection element is formed so as to be (e.g. detachably) connectable to an external pressurized air source.

The compressed air connection element may be connectable to an external pressurized air source. The term "external pressurized air source" denotes an air source, which is located spaced apart from the arrangement and in particular the suction unit. Specifically, the external pressurized air source is structurally decoupled from the components of the arrangement. Only an air connection, for example an air hose, may be provided between the suction unit and the pressurized air source. For example, the compressed air connection element may be standardized in order to comply with a specific regional industry standard, such that, for example, the compressed air connection element is connectable to a standardized external pressurized air source by a simple plug connection. Furthermore, the compressed air connection element may be formed with a screw or bayonet connection for detachably connecting the compressed air connection element to the external pressurized air source.

Furthermore, a connection tube may be arranged between the compressed air connection element and the external pressurized air source so that the distance between the compressed air connection element and the external air source is bridged. For example, a coiled or rolled up flexible hose may be fixed to the guiding structure and connected to the compressed air connection element. Hence, the flexible hose may be uncoiled and connected to the spaced apart external pressurized gas source. Hence, a very flexible and robust arrangement for handling flat elements may be provided.

The paper processing device may for example, be a paper cutting machine, a paper printing machine, a platen press, a feeding machine or a paper removing or stripping machine. The cutting machine may be designed for cutting the flat element, for example. A paper printing machine may be designed for coloring and printing the flat elements, for example. The feeding machine may be for example a machine providing a stack of flat elements and for moving one of the flat elements of the stack to the subsequent further paper processing device, for example. A paper stripping machine may be for example a machine for receiving the flat elements after being processed in the paper processing device, for example. The arrangement, and in particular the guiding structure with the hold-down element, may be in particular coupled between two paper processing devices. Hence, the arrangement for handling flat elements may orientate and hold the flat elements within a predefined orientation such that an accurate and exact feeding of a respective paper element into the subsequent paper processing device is provided.

The external pressurized air source may for example be a pressurized air source of the paper processing device. Hence, the arrangement may be retrofitted to the system and hence to the paper processing device, because the suction unit of the arrangement may be coupled by the compressed air connection element to the external pressurized air source of the paper processing device.

The building system may be for example a factory building, in which a pressurized air system (comprising for example the external pressurized air source as described above in connection with the arrangement) for supplying standardized nominal air pressure is installed. The pressurized air system may comprise lines running through the building, wherein at desired locations, connection locations are installed. The compressed air connection element of the arrangement is detachably coupled to one of the connection locations, so that the above-described arrangement handling flat elements may be connected to the pressurized air system at a variety of different locations. Hence, the arrangement is flexibly connectable to an external pressurized air system and an external pressurized air source so that a flexible location of the arrangement may be provided.

According to a further exemplary embodiment, the hold-down element is mounted to a supporting frame in an exchangeable and replaceable manner.

Hence, the hold-down element is, for example, exchangeable for maintenance reasons, for example. Furthermore, it is possible to flexibly add or remove hold-down elements. For example, a plurality of hold-down elements may be added to the supporting frame for improving the holding down capacity. However, it is also possible to reduce the holding down capacity by removing some or all of the arranged hold-down elements. Hence, the holding down capacity of the arrangement may be adjusted flexibly. The hold-down element is for example fixed to the supporting frame by a screw connection. However, also plug connections may be used for fixing the hold-down element removably to the supporting frame.

According to a further exemplary embodiment, the hold-down element is mounted to the supporting frame such that the hold-down element is adjustable along the transport direction. Hence, the location of the suction force with respect to an upstream or downstream (with respect to the transport direction) located processing device is adjustable.

According to a further exemplary embodiment, the hold-down element is movable with respect to the supporting frame between an active position for holding the flat element down and an inactive position, wherein the flat element is movable for passing the support section of the hold-down element. The active position of the hold-down element is a position in which the flat element is arranged on the support section of the hold-down element. Hence, the flat element is fixed to the supporting section by drawing air through the suction hole. In an inactive position of the hold-down element, the hold-down element is moved in a position, where the flat element is not arranged onto the support section, such that the air drawn through the suction holes does not hold the flat element.

Specifically, the hold-down element and more specifically the support section of the hold-down element is movable in the direction toward the support area of the guiding structure and away from the support area of the guiding structure. For example, the hold-down element may be coupled to a guiding rail of the supporting frame so as to be movable between the active and the inactive positions.

Additionally, according to a further exemplary embodiment of the present invention, the hold-down element is formed and arranged such that the hold-down element is rotatable between the active position and the inactive position. Hence, by rotating the hold-down element from the active position to the inactive position, the outlet of the suction holes and, in other words, the support section of the hold-down element are rotated in the active position or away from the active position in the inactive position.

For example, in the active position, the support section may be arranged in the same plane as the supporting area of the guiding structure. In the inactive position, the support section is moved and in particular rotated away from the plane in which the support area of the guiding structure is arranged.

However, the hold-down element may be formed by a hollow rectangular beam, wherein one surface of the rectangular beam forms the support section including the suction holes. Furthermore, in an exemplary embodiment, a further surface of the rectangular beam may form a further support section comprising further suction holes coupled also to the suction opening of the suction device. For example, the amount of the further suction holes and/or the diameter of the further suction holes of the further support section may differ from the amount of the suction holes and/or of the diameter of the suction hole of the support section. Hence, a different suction capacity between the support section and the further support section is provided. This causes a desired suction capacity may be adjusted simply by rotating the hold-down element.

According to a further exemplary embodiment, the hold-down element comprises a plurality of suction holes coupled to the suction opening of the suction unit. In particular, the suction holes are arranged one after another along a row, or distributed sequentially along or distributed or arranged in a two dimensional pattern along or across the support section hold-down element; wherein the suction holes extend in particular perpendicular with respect to the transport direction. However, in a further exemplary embodiment, also further rows of suction holes may be arranged parallel to the above described row, for example.

According to a further exemplary embodiment, the support section comprises an edge extending perpendicular to the transport direction, wherein the support section comprises a total width defined along the transport direction. Each of the suction holes is arranged spaced away from the edge at a distance of ⅓, ⅕ or 1/10 of the total width of the support section. Hence, if the suction holes are arranged close to the edge which is the downstream edge with respect to the transport direction, an upstream end of the flat element may be held to the support section of the hold-down element, wherein the downstream end of the flat elements may be already located within the subsequent paper processing device, for example.

It is to be noted that embodiments of the invention are described with reference to different subject matters. In particular, some embodiments are described with reference to apparatus type claims whereas other embodiments are described with reference to method type claims. However, a person skilled in the art will be aware from the above and the following description that, unless other notified, in addition to any combination of features belonging to one type of subject matter, also any combination between features relating to different subject matters, in particular between features of the apparatus type claims and features of the method type claims, is to be considered as disclosed with this application.

BRIEF DESCRIPTION OF THE DRAWINGS

The aspects defined above and further aspects of the present invention are apparent from the examples of embodiments described hereinafter and are explained with reference to the examples of embodiment. The invention will be described in more detail hereinafter with reference to examples of embodiments but to which the invention is not limited.

DETAILED DESCRIPTION OF EXEMPLARY EMBODIMENTS

Figure 1:
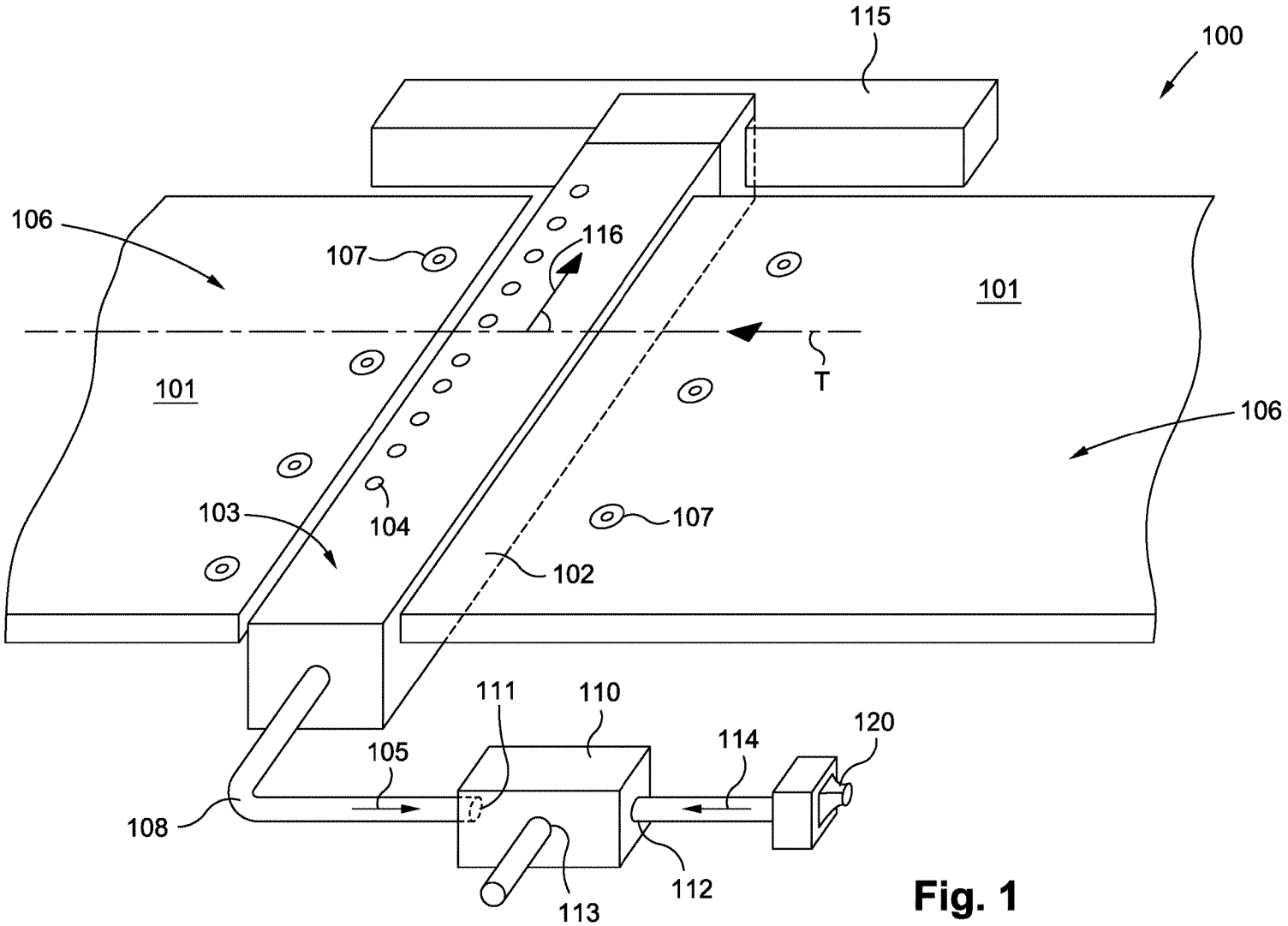
FIG. 1 shows a schematic view of an arrangement for handling flat elements according to an exemplary embodiment of the present invention.

The illustrations in the drawings are schematic. It is noted that in different figures similar or identical elements are provided with the same reference signs.

FIG. 1 shows an arrangement 100 for handling flat elements 202, in particular paper elements 202, according to an exemplary embodiment of the present invention. A guiding structure 101 is provided, along which a flat element 202 is guidable and transportable along a transport direction T. A hold-down element 102 is coupled to the guiding structure 101 for holding the flat element 202 down to the guiding structure 101, wherein the hold-down element 102 comprises a support section 103 on which the flat element 202 is supportable. The support section is at or near to the plane of the guiding structure 101 adjacent the support section. The support section 103 has suction holes 104 therethrough which air is drawn for holding the flat element 202 down on the support section 103. The hold-down element 102 extends along an extending direction 116 which in the exemplary embodiment is perpendicular to the transport direction T. The suction holes 104 are arranged one after another along the extending direction 116.

A suction unit 110 is arranged spaced apart or remote from the hold-down element 102. The suction unit comprises a suction opening 111 so as to be coupled to the suction holes 104 of the hold-down element 102, an air inlet 112 and an air outlet 113, wherein the suction unit 110 is formed such that compressed air is directed from the air inlet 112 to the air outlet 113 for generating a compressed air stream 114. The suction opening 111 is formed and arranged such that the compressed air stream 114 passes the suction opening 111 so that compressed air stream 114 entrains air through the suction opening 111. A compressed air connection element 120 is coupled to the air inlet 112 of the suction unit 110, wherein the compressed air connection element 120 is formed so as to be connectable to an external pressurized air source 220.

Figure 2:
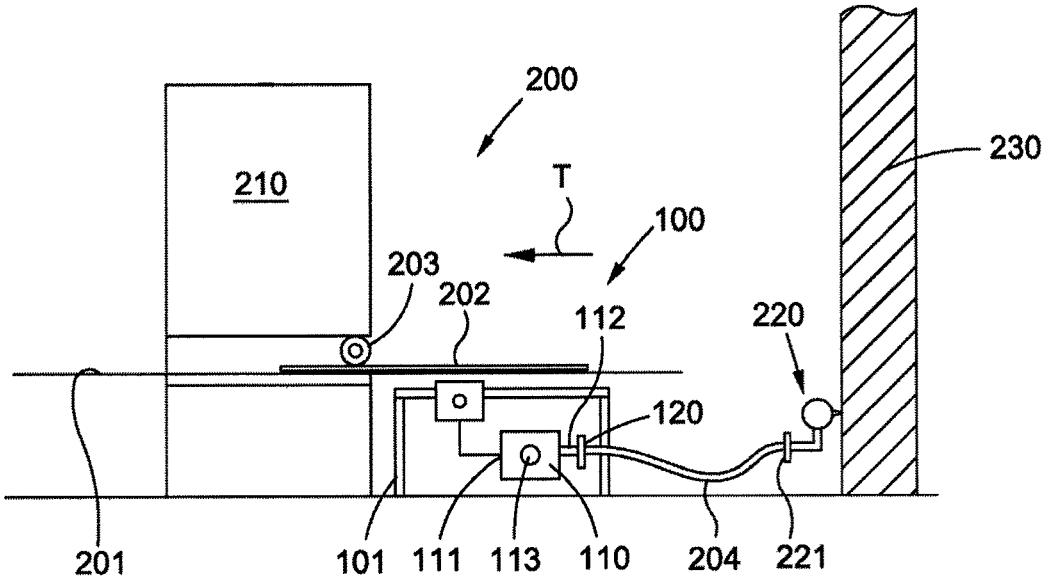
FIG. 2 shows a schematic view of a system for processing flat elements and of a building system according to an exemplary embodiment of the present invention.

The flat elements may in the exemplary embodiment be example flat paper sheets 202 (see FIG. 2). For example, the flat elements 202 are sheet-like in shape and may be stackable on top of each other to form a stack of flat elements 202. The flat elements 202 are, for example, paper sheets made of a paper or a carton/cardboard structure.

The transport direction T describes the direction of movement of the flat elements 202 during the processing of the flat elements 202. The transport direction T describes the direction of movement of the flat elements 202 along the sheet conveyance path when each element is passing the hold-down element 102.

The guiding structure 101 comprises for example a support area 106 on which the flat elements 202 are supportable and are movable along the transport direction T. In particular, the hold-down element 102 is interposed upstream and downstream of the respective support areas 106 of the guiding structure 101 with respect to the transport direction T. Furthermore, the guiding structure 101 is fixed to a supporting frame 115, a ground and/or to a subsequent processing device, in particular, a paper processing device 210 (see FIG. 2) such that the flat elements 202 are guidable along the guiding structure 101 to the processing device 210. The guiding structure 101 may for example comprise a conveyor belt 201 or other transport rollers 107 on which the flat elements 202 are movable and guidable. As seen in FIG. 1, the supporting frame 115 may be formed of a framework made of bars or the like, for example.

The hold-down element 102 is a beam comprising a rectangular cross-section. The hold-down element 102 is coupled to the guiding structure 101 permanently or removably. The hold-down element 102 comprises the support section 103 on which the flat element 202 is supportable by moving along the transport direction T. When passing the support section 103 of the hold-down element 102, the flat element 202 is held down to the support section 103 and for example fixed to the support section 103 such that a further movement of the flat elements 202 along the transport direction T is disabled or decelerated.

The hold-down element 102 comprises the suction holes 104 through which air is drawn for holding the flat element 202 down on the support section 103. In particular, an underpressure is generated within the hold-down element 102, such that the air is drawn from the outside of the hold-down element 102 through the respective suction holes 104 into the hold-down element 102. The flat element 202 is thereby held down to the support section 103.

Figure 3:
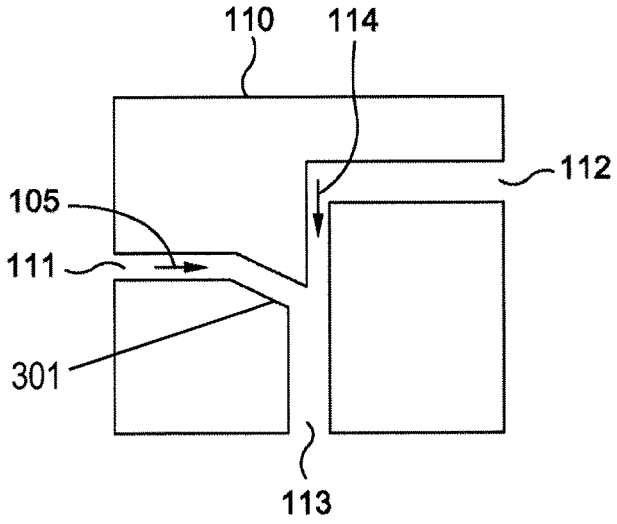
FIG. 3 shows a schematic view of a suction unit according to an exemplary embodiment of the present invention.

In order to generate the underpressure within the hold-down element 102, the suction unit 110 is coupled by a suction opening 111 to the respective suction holes 104. A connection tube 108 may couple the hold-down element 102 to the suction opening 111 of the suction unit 110. A suction air stream is generated between the suction holes and the suction opening 111. An external pressurized air source 220 (see FIG. 2), such as an air pump and the like as described further in detail below, is coupled to the air inlet 112 of the suction unit 110. A compressed air stream 105 is thereby formed between the air inlet 112 and the air outlet 113 of the suction unit 110. That compressed air stream 114 passes the suction opening 111 to entrain the air from the suction holes 104 through the suction opening 111 for providing the underpressure within the hold-down element 102. A more detailed view of the suction unit 110 is shown in FIG. 3.

The suction unit 110 is arranged spaced apart from the hold-down element 102 and is coupled e.g. by a connection tube 108 to the respective suction holes 104. Hence, the hold-down element 102 may be manufactured for example as a hollow bar comprising the suction holes 104 so that the hold-down element 102 is easy to install to the respective guiding structure 115. No further movable or other installations inside the hold-down element 102 are necessary for controlling the air flow through the suction holes 104 are necessary. Furthermore, the hold-down element 102 is free of any further technical installations.

The hold-down element 102 comprises a plurality of suction holes 104 coupled to the suction opening 111 of the suction unit 110. In particular, the plurality of suction holes 104 is arranged one after another along a row, wherein the row extends along the extending direction 116 perpendicular to the transport direction T. However, in a further exemplary embodiment, further rows of suction holes 104 may also be arranged parallel to the above described row, for example.

The hold-down element 102 is mounted to the supporting frame 115 in an exchangeable manner, for example for maintenance reasons. The hold-down element 102 is mounted to the supporting frame 115 to be adjustable along transport direction T. Hence, the location (i.e. the point of action) of the suction force with respect to an upstream or downstream (with respect to the transport direction T) located processing device 210 is adjustable.

FIG. 2 shows a system 200 for processing flat elements 202, in particular paper elements 202. The system 200 comprises a (paper) processing device 210 for processing flat elements 202 and an arrangement 100 as shown in FIG. 1. The guiding structure 101 of the arrangement 100 is coupled to the (paper) processing device 210 in such a way that the flat elements 202 are guidable and transportable along the transport direction T and then from the (paper) processing device 210.

Furthermore, a building system, i.e. a wall of a building 230 is shown. The building 230 comprises a pressurized air system comprising a pressurized air source 220 and a plurality of connection locations 221 which are coupled to the pressurized air source 220 for receiving pressurized air. The compressed air connection element 120 of the arrangement 100 is detachably coupled to one of the connection locations 221. The flexible and variable compressed air connection element 120 is coupled to the air inlet 112 of the suction unit 110.

Furthermore, between the compressed air connection element 120 and the external pressurized air source 220, a connection tube 204 is arranged so that the distance between the compressed air connection element 120 and the external air source 220 is bridged.

The paper processing device 210 is for example a paper cutting machine, a paper printing machine, a platen press, a feeding machine or a paper stripping machine. The arrangement 100, and in particular the guiding structure 101 with the hold-down element 102, is coupled upstream with respect to the transport direction T before the paper processing device 210. Hence, the arrangement 100 for handling flat elements 202 orients and holds the flat elements 202 in a predefined orientation such that an accurate and exact feeding of the respective paper element 202 into the subsequent paper processing device 210 is provided. The hold-down element 102 extends perpendicular to the transport direction T. The paper processing device 210 may comprise for example roller elements 203 for feeding the respective paper element 202 into the paper processing device 210.

FIG. 3 shows a schematic view of a suction unit 110 according to an exemplary embodiment of the present invention. The compressed air stream 114 guides air under pressure through the suction unit 110 between the air inlet 112 and the air outlet 113, wherein the compressed air stream 114 communicates laterally with the suction opening 111. The suction opening 111 forms a throttle section 301 and hence comprises a smaller opening diameter (i.e. at the downstream end of the suction opening 111 inside the suction device 110) close to the compressed air stream 114 than the larger opening diameter (i.e. at the upstream end of the suction opening 111) close to the suction hole 104 of the hold-down element 102. Hence, a Venturi effect creates a vacuum inside the suction opening 111 such that air is sucked from the suction through hole 104 of the hold-down element 102 into the suction unit 110.

Hence, it is possible to connect a pressurized air source 220 to the suction unit 110 in order to draw air through the suction opening 111 and further to blow the air through the air outlet 113 out of the suction unit 110.

Figure 4:
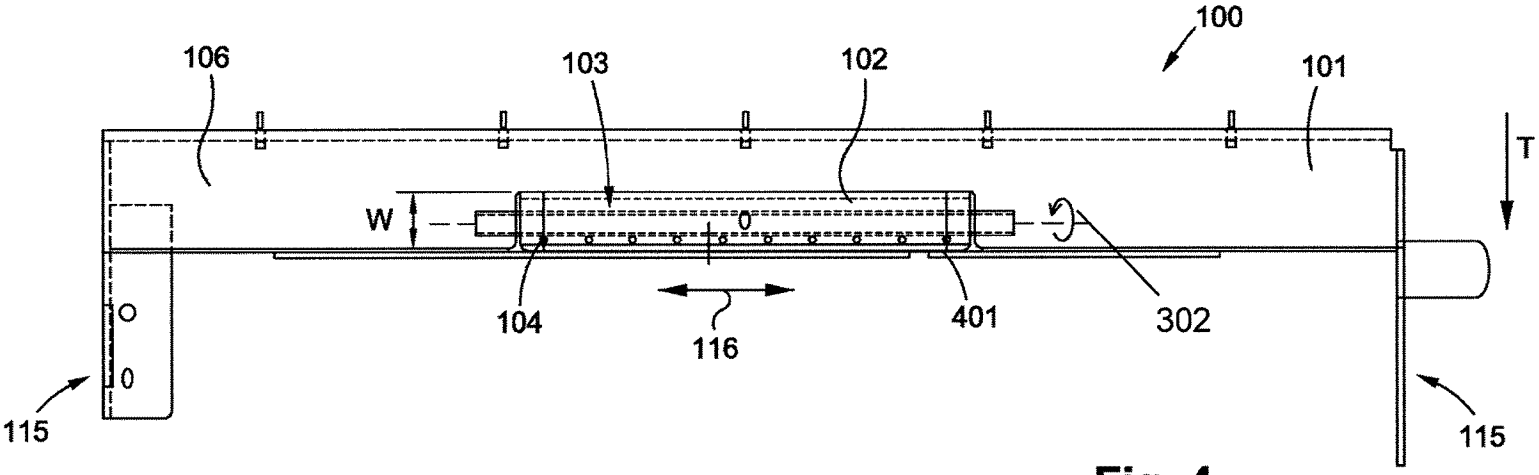
FIG. 4 and FIG. 5 respectively show schematic views of a top view and a side view of the arrangements for handling elements, wherein the hold-down element is rotatable according to an exemplary embodiment of the present invention.
Figure 5:
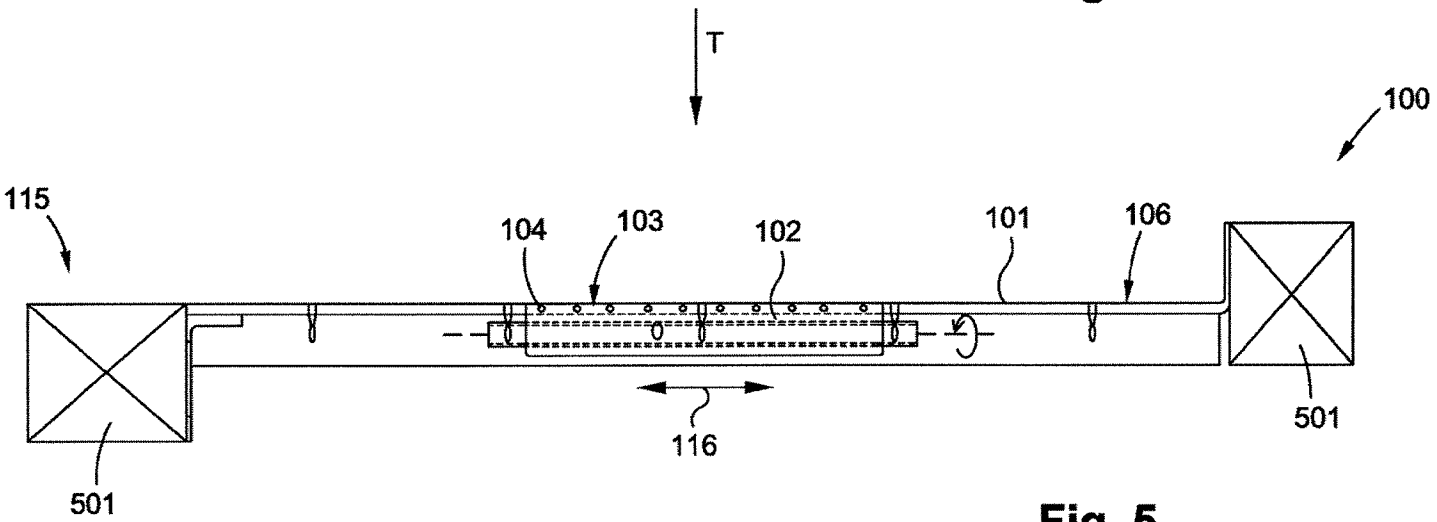

FIG. 4 shows a top view and FIG. 5 a side view of the supporting frame 115, the guiding structure 101 and the hold-down element 102 according to an exemplary embodiment of the present invention. The guiding structure 101 and the hold-down element 102 are mounted to mounting bars 501 of the supporting frame 115. The hold-down element 102 is movable with respect to the guiding structure 101 between an active position for holding the flat element 202 down and an inactive position in which the flat element 202 is movable for passing the support section 103 of the hold-down element 102. The active position as shown in FIG. 4 and FIG. 5 of the hold-down element 102 is defined by a position wherein the flat element 202 is arranged on the support section 103 of the hold-down element 102 and hence the flat element 202 is sucked to the supporting section 103 by sucking air through the suction holes 104. In an inactive position of the hold-down element 102 with respect to the guiding structure 101, the flat element 202 is not supported on the support section 103, such that the air drawn through the suction holes 104 does not hold the flat element 202 to the support section 106.

Specifically, the hold-down element 102 and more specifically the support section 103 of the hold-down element 102 is movable in the direction to the support area 106 of the guiding structure 101 and also away from the support area 106 of the guiding structure 101. As shown in FIG. 4 and FIG. 5, the hold-down element 102 is formed such that the hold-down element 102 is rotatable (indicated by the arrow 302 in FIG. 4 and FIG. 5) between an active position and an inactive position. Hence, by rotating the hold-down element 102 from the active position to the inactive position, the outlet of the suction holes 104 and in other words the support section 103 of the hold-down element 102 is rotated into the active position or away from the active position into the inactive position.

For example, in the active position, the support section 103 may be arranged in the same plane as the supporting area 106 of the guiding structure 101 (see FIG. 4 and FIG. 5). In the inactive position, the support section 103 is moved and in particular rotated out of the plane, in which the support area 106 of the guiding structure 101 is arranged.

The hold-down element 102 is in particular formed by a hollow rectangular beam, wherein one surface of the rectangular beam forms the support section 103 including the suction holes 104. Furthermore, in an exemplary embodiment, a further surface of the rectangular beam may form a further support section comprising further suction holes coupled also to the suction opening of the suction device. For example, the quantity of the further suction holes and/or the diameter of the further suction holes of the further support section may differ from the quantity of the suction holes 104 and/or of the diameter of the suction holes of the support section 103. Hence, a different suction capacity between the support section 103 and the further support section is provided.

The support section 103 comprises an edge 401 extending along the extending direction 116 and perpendicular to the transport direction T, wherein the support section comprises a total width w defined along the transport direction T. Each of the suction holes 104 is arranged spaced apart from the edge 401 with a distance of ⅓, ⅕ or 1/10 of the total width w of the support section 103. Hence, if the suction holes 104 are arranged close to the edge 401 which is the downstream edge with respect to the transport direction T, an upstream end of the flat element 202 may be held to the support section 103 of the hold-down element 102, wherein the downstream end of the same flat element 202 may be already located within the subsequent paper processing device 210, for example.

Figure 6:
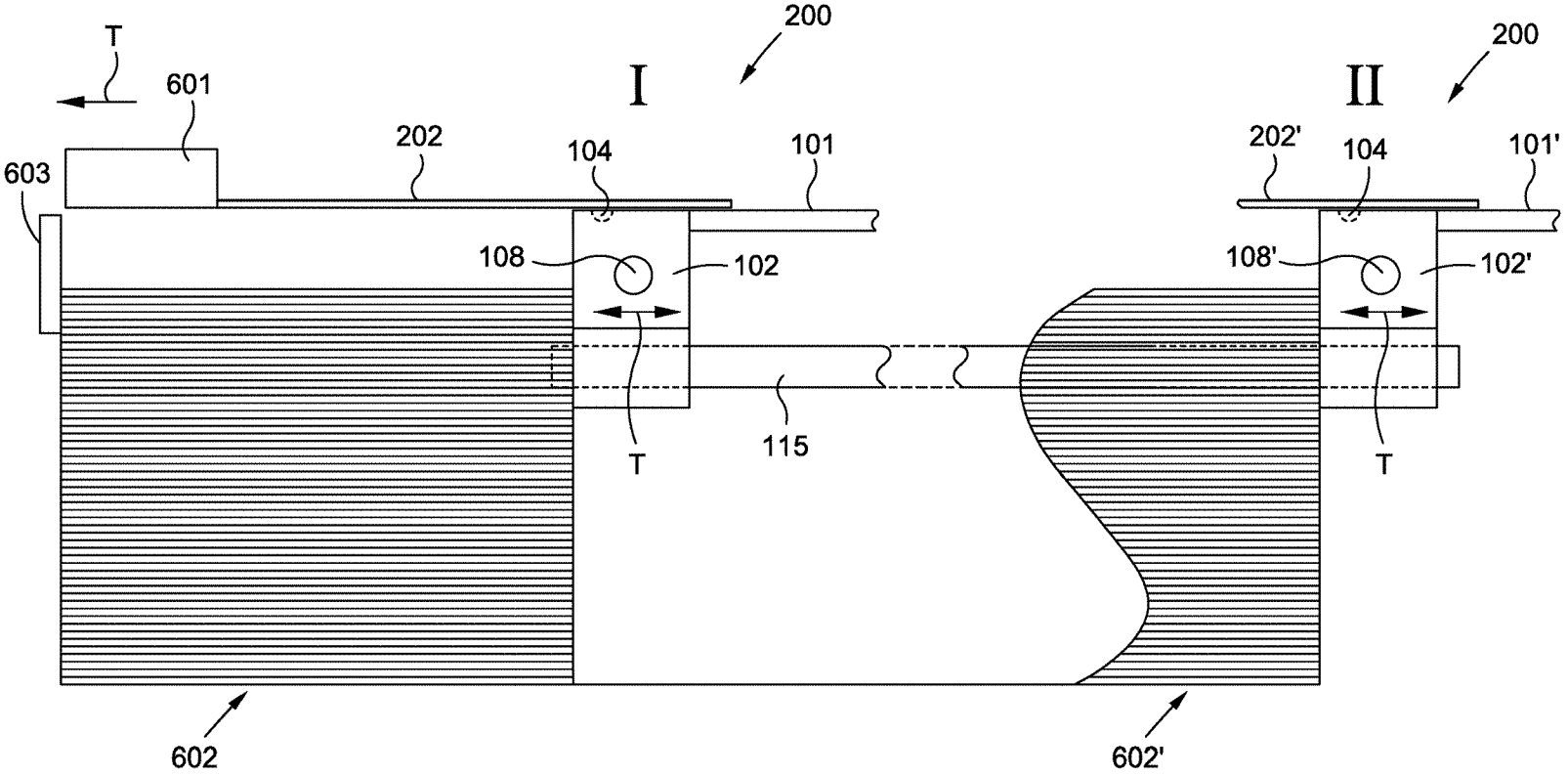
FIG. 6 and FIG. 7 respectively show schematic side views of a system for processing flat elements, wherein a gripper bar device moves the flat elements to a stack of flat elements according to an exemplary embodiment of the present invention.
Figure 7:
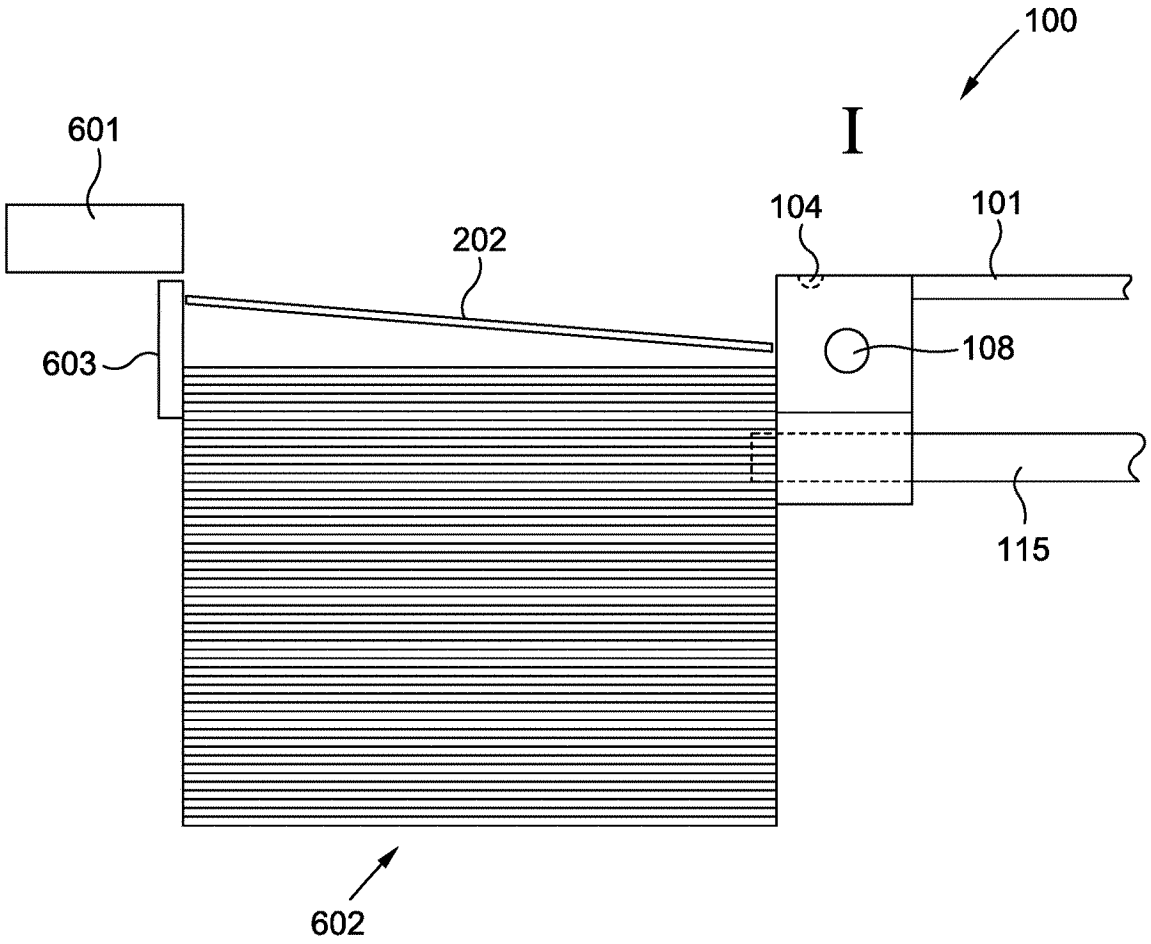

FIG. 6 and FIG. 7 show a system 200 for processing flat elements, wherein a gripper bar device 601 of the system 200 moves the flat elements 202, 202' to a stack 602 of flat elements 202, 202' according to an exemplary embodiment of the present invention.

The gripper bar device 601 is movable along the transport direction T. The gripper bar device 601 is adapted for gripping (mechanically or by underpressure) a flat element 202, 202' selectively, such that the flat element 202, 202' can be moved with the gripper bar device 601 along the transport direction T.

The hold-down element 102 is arranged in position I closer to a stopper element 603 than in position II. The location of the hold-down element 102 in position I is used for flat elements 202 with a smaller width and the position II of the hold-down element 102' is used for flat elements 202' with a larger width.

In the exemplary embodiment shown in FIG. 6 and FIG. 7, the hold-down element 102, 102' is movable along the transport direction T along the supporting frame 150 so that the hold-down element 102, 102' is adjustable with respect to a size of the flat elements 202, 202'.

In the exemplary embodiment shown in FIG. 6 and FIG. 7, the flat elements 202, 202' are fixed at a desired position by the hold-down elements 102, 102'. Next, as shown in FIG. 7, the gripper bar device 601 grips the respective flat element 202 and moves the respective flat element 202 to a stopper element 603. Next, the gripper bar device 601 releases the respective flat element 202 and the flat element 202 is laid on a stack 602 of flat elements 202.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Figure 8:
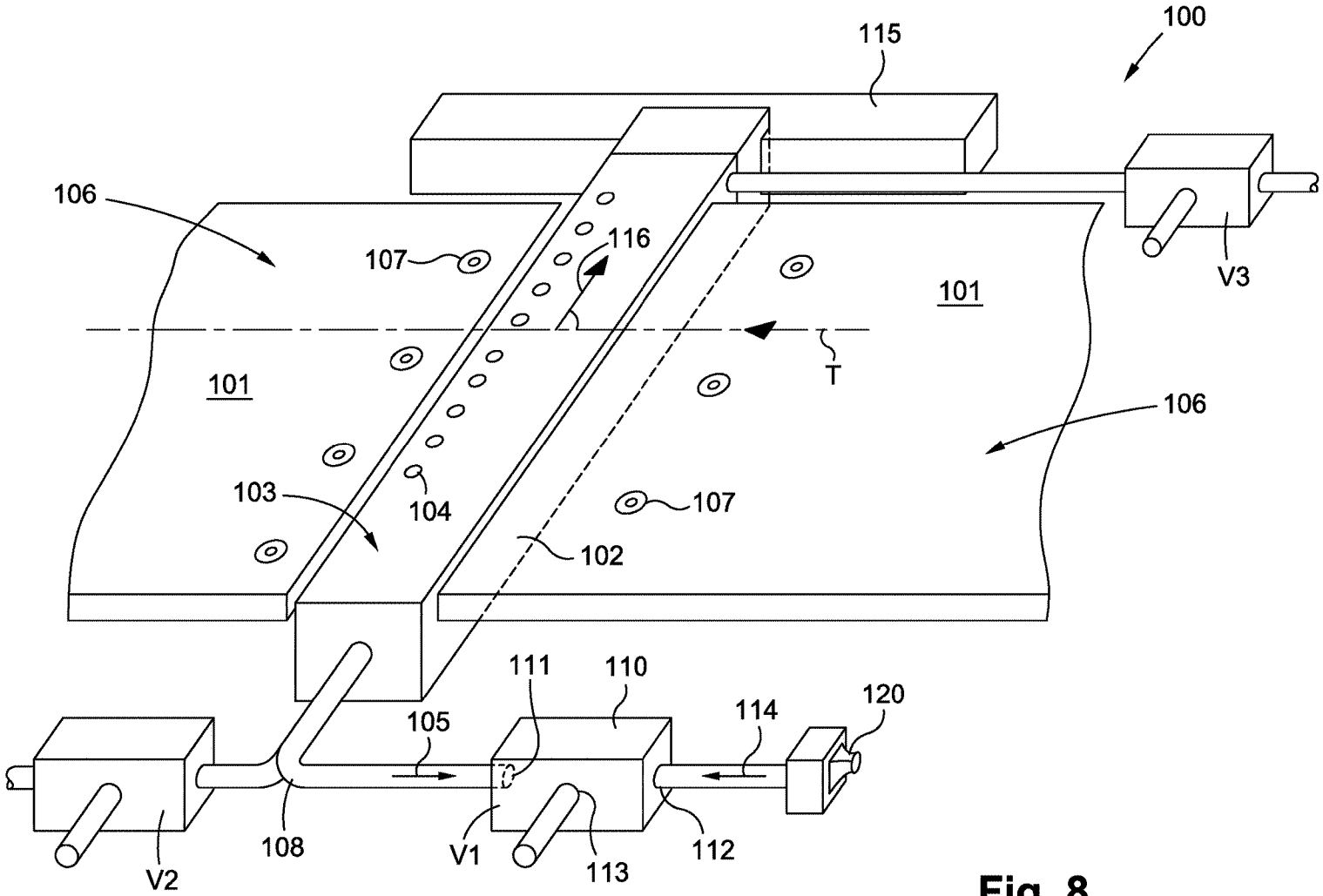
FIG. 8 shows a schematic view of an arrangement for handling flat elements according to an exemplary embodiment of the present invention in which two or more suction units are employed.

In certain embodiments two or more suction units may be provided, as is illustrated by way of example by the presence of suction units 110 in FIG. 8; here referenced V1, V2 and V3.

In certain of these arrangements the different suction units provide the suction effect in different zones of the hold down element. For example, one suction element could provide the suction effect in a part of the hold down element corresponding to the area occupied by a sheet having a first (smaller) dimension in the direction of the hold down device, as it passes over the hold down element in use. This zone could be in a central part of the hold down element, for example. A second suction element could provide the suction effect in the remaining parts of the hold down element, corresponding to the area occupied by a sheet having a second (larger) dimension in the direction of the hold down device, as it passes over the hold down element in use.

This arrangement allows the suction elements that are needed to hold down a particular sheet size or width (for a particular job) to be activated and those which are not needed to be deactivated. This brings benefits of reduced energy consumption and reduced noise. For increased energy efficiency, internal baffles may be introduced in the hold down device segregating one zone of the hold down element from the other. This may have the effect of preventing or restricting air flow between a suction hole associated with a first zone and a suction unit associated with a second zone. While any suitable form of baffle may be used, in one simple embodiment one or more simple bungs or other blockage made from any suitable material may be inserted into the hold down element moved to one or more predetermined positions. An interference fit between the bungs and the interior surface of the hold down element may be used to ensure that the bungs do not move from their intended position.

It will be understood that where more than two widths of sheet are used, for example three or four widths, further hold down zones may be employed with further corresponding suction units.

In other arrangements two or more suction units could be connected to the same zone of the hold down element. In this manner, the suction effect acting in a given zone could be increased for a given a level of suction associated with a given suction unit. One or more suction units could be connected to one side of the hold down device 102, as is illustrated by suction units V1 and V2 in FIG. 8. Alternatively, the one or more suction units could be connected to the other side of the hold down device 102, as is illustrated by suction unit V3 in FIG. 8. As a further alternative, one or more suction units could be connected to a first side of the hold down device 102 and the same or indeed a further one or more suction units may be connected to the second side of the hold down device 102. In this manner the suction force at different points along the length of the hold down device 102 may be brought to the desired level and thus embodiments of the present invention would be suitable for a working with greater range of sheet substrates (for example, heavier substrates or substrates with different surface finishes) and sheet handling speeds.

It will also be understood that in yet other arrangements of the invention the hold down element may be divided into zones with each zone being provided with suction by at least one suction unit but with certain zones being provided with suction from two or more suction units. In this manner the certain zones may be subject to significantly different levels of suction forces to others.

LIST OF REFERENCE SIGNS

| | |
|---|---|
| 100 | arrangement |
| 101 | guiding structure |
| 102 | hold-down element |
| 103 | support section |
| 104 | suction hole |
| 105 | suction air stream |
| 106 | support area |
| 107 | transport rollers |
| 108 | connection tube |
| 110 | suction unit |
| 111 | suction opening |
| 112 | air inlet |
| 113 | air outlet |
| 114 | compressed air stream |
| 115 | supporting frame |
| 116 | extending direction |
| 120 | compressed air connection element |
| 200 | system |
| 201 | conveyor element |
| 202 | (paper) flat elements/sheets |
| 203 | roller element |
| 204 | connection tube |
| 210 | paper processing device |
| 220 | external pressurized air source |
| 221 | connection locations |
| 230 | building |
| 301 | throttle section |
| 401 | edge |
| 501 | support bar |
| 601 | gripper bar |
| 602 | stack of flat elements |
| I | position of hold-down element |
| II | further position of hold-down element |
| T | Transport direction |
| w | total width |

The invention claimed is:

1. An arrangement for handling flat elements, the arrangement comprising:

a guiding structure along which a flat element is guidable and transportable along a transport direction (T), a hold-down element which is coupled to the guiding structure and located and configured for holding the flat element down to the guiding structure, the hold-down element comprises a support section on which the flat element is supportable, wherein the support section comprises suction holes through which air is drawn for holding the flat element on the support section, wherein the hold-down element extends along an extending direction having a component perpendicular to the transport direction (T), wherein the suction holes are arranged along the extending direction, a suction unit comprising a suction opening configured to be coupled to the suction holes of the hold-down element, wherein the suction unit is separate from and spaced apart from the hold-down element, the suction unit having an air inlet and an air outlet, the suction unit is configured such that air is directed from the air inlet to the air outlet for generating an air flow, and the suction opening is formed and arranged such that the air flow passes the suction opening such that the passing air flow entrains air through the suction opening.

2. The arrangement according to claim 1, further comprising:

a compressed air connection element coupled to the air inlet of the suction unit, wherein the compressed air connection element is formed to be connectable to an external pressurized air source.

3. The arrangement according to claim 1, further comprising:

a supporting frame, configured for and having the hold-down element mounted to the supporting frame in an exchangeable manner for the hold down element.

4. The arrangement according to claim 3, wherein the hold-down element is mounted to the supporting frame such that the hold-down element is adjustable along the transport direction (T).

5. The arrangement according to claim 3, wherein the hold-down element is movable with respect to the supporting frame between an active position where the hold down element is located and configured for holding the flat element down and an inactive position at which the flat element is movable for passing the support section of the hold-down element.

6. The arrangement according to claim 5, wherein the hold-down element is configured to be rotatable such that the hold-down element is rotatable between the active position and the inactive position.

7. The arrangement according to claim 6, further comprising:

a connection tube which couples the through holes of the hold-down element to the suction opening of the suction unit.

8. The arrangement according to claim 7, wherein the support section comprises an edge extending along the extending direction, and the support section has a total width (w) defined along the extending direction, and wherein each of the suction holes is arranged spaced apart from the edge at a distance of ⅓, ⅕ or 1/10 of the total width (w) of the support section.

9. A system for processing flat elements, the system comprising:

a processing device for processing flat elements, and an arrangement according to claim 1, wherein the guiding structure of the arrangement is coupled to the processing device such that the flat elements are guidable and transportable along a transport direction (T) to or from the processing device.

10. A system according to claim 9, wherein the processing device is selected from one of the group consisting of paper cutting machines, paper printing machines, feeding machines and paper stripping machines.

11. The arrangement according to claim 1, wherein the guiding structure for the flat element has a level and the support section at the suction holes is at the level of the guiding structure.

12. The arrangement according to claim 1, further comprising a processing device for processing a flat element, the processing device being located downstream from the support structure in the transport direction by a distance selected such that when a flat element leading end in the transport direction is transported to be at the processing device, a trailing end of the flat element is at the suction holes.

13. The arrangement according to claim 1, wherein the support section further comprises a connection tube configured to conduct air let in through the suction holes to a first point outside of the hold-down element, and the suction opening of the suction unit is coupled to the first point of the connection tube of the hold-down element.

14. A method for handling flat elements, the method comprising:

guiding and transporting a flat element along a transport direction (T) by a guiding structure, holding the flat element to the guiding structure by a hold-down element, which is coupled to the guiding structure, wherein the hold-down element comprises a support section on which the flat element is supported, the support section comprises suction holes through which air is drawn for holding the flat element on the support section, wherein the hold-down element extends along an extending direction having a component perpendicular to the transport direction (T), wherein the suction holes are arranged along the extending direction, wherein a suction unit comprises a suction opening configured to be coupled to the suction holes of the hold-down element, wherein the suction unit is separate from and spaced apart from the hold-down element;

wherein the suction unit is directing air from an air inlet of the suction unit to an air outlet of the suction unit for generating an air flow between the air inlet and the air outlet, wherein the suction opening is configured and arranged such that the air passes the suction opening so that the air passing the suction opening entrains air through the suction opening.

15. The method according to claim 14, wherein the support section further comprises a connection tube configured to conduct air let in through the suction holes to a first point outside of the hold-down element, and the suction opening of the suction unit is coupled to the first point of the connection tube of the hold-down element.

* * * * *